United States Patent [19]

Shamir

[11] 4,418,978

[45] Dec. 6, 1983

[54] FUSE PLUG

[75] Inventor: Amos Shamir, Brooklyn, N.Y.

[73] Assignee: Paramount Die & Machine Products, Brooklyn, N.Y.

[21] Appl. No.: 384,615

[22] Filed: Jun. 3, 1982

Related U.S. Application Data

[63] Continuation of Ser. No. 200,456, Oct. 24, 1980, abandoned.

[51] Int. Cl.[3] ..... H01R 13/36

[52] U.S. Cl. ..... 339/99 R; 339/147 P

[58] Field of Search ..... 337/197, 198, 201, 214, 337/264; 339/63 R, 97 R, 97 P, 99 R, 103 R, 206, 207, 209, 210, 147 P

[56] References Cited

U.S. PATENT DOCUMENTS

| | | | |
|---|---|---|---|
| 1,902,568 | 3/1933 | Maxam | 337/201 |
| 3,716,820 | 2/1973 | Deakin | 339/147 P |
| 3,829,819 | 8/1974 | Eckart | 339/147 P |
| 3,832,676 | 8/1974 | Joly | 339/147 P |
| 4,130,333 | 12/1978 | Djurinec | 339/97 P |
| 4,178,061 | 12/1979 | Ahroni | 339/147 P |

*Primary Examiner*—Joseph H. McGlynn

*Attorney, Agent, or Firm*—Wolf, Greenfield & Sacks

[57] ABSTRACT

A combination plug and fuse holder provides fuse protection for appliances, extension cords, ornamental lighting and other electrical products wherein fuse protection is desirable. The fuse plug is of molded fire-retardant plastic having three separate members that are hinged together to form an integral unit. The housing members include a base member, an overlying body member hinged from the base member, together forming a fuse-accommodating pocket, and an end member hinged from the base member and carrying one of the electrical prongs. The other electrical prong extends from the body member and the electrical cord is adapted to fit between the base and body members. Removal of the fuse can be accomplished simply by unlocking the end member and pivoting it from the base member to permit withdrawal of the fuse.

13 Claims, 6 Drawing Figures

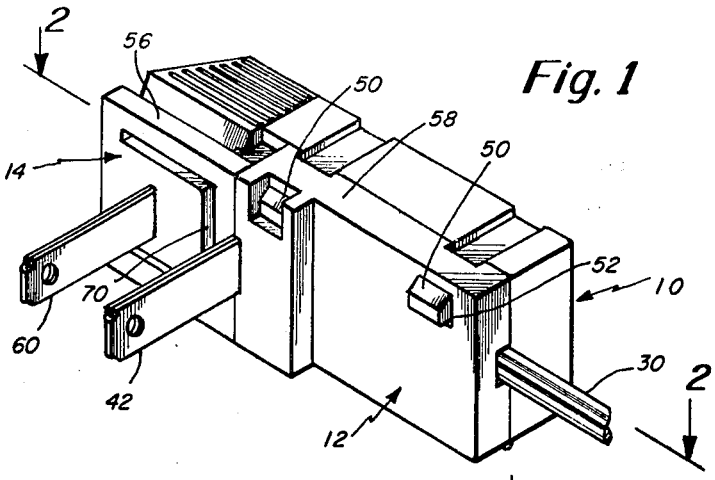
Fig. 1
Fig. 2
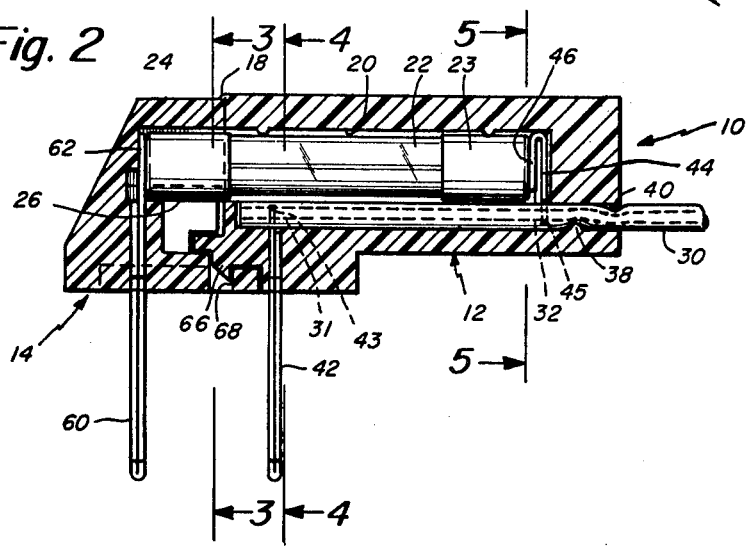
Fig. 3
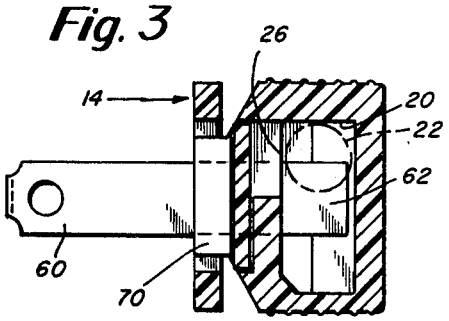
Fig. 4
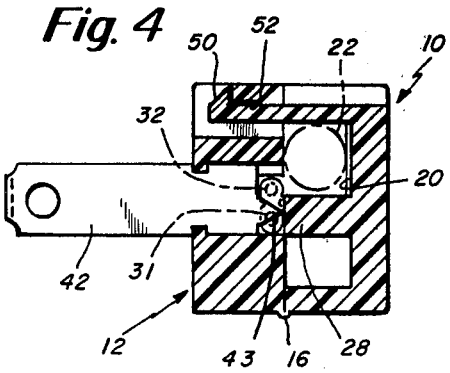

FUSE PLUG

This is a continuation of application Ser. No. 200,456, filed Oct. 24, 1980, now abandoned.

BACKGROUND OF THE INVENTION

The present invention relates in general to fusing in connection with electrical devices, and pertains, more particularly, to a combination plug and fuse holder preferably embodied in a single integral unit preferably constructed of a fire retardant plastic.

There have been recent requirements for the use of a fuse directly in connection with certain electrical appliances such as the requirement for fusing a Christmas light string. The usual technique for incorporating the fuse is to provide a separate fuse and associated holder connected into the electrical cord at some position along its length. However, this arrangement usually makes it relatively difficult to provide for replacement of the fuse in an easy manner.

Accordingly, one object of the present invention is to provide a combination fuse holder and plug preferably provided in an integral unit and wherein the fuse is very simple to replace without requiring the disconnection of any parts.

Among other objects of the present invention is the object of providing a fuse plug in which the assembly of the fuse on the cord is facilitated at a low cost without requiring wire stripping or notching. In accordance with this invention the electrical cord is placed into the housing but without requiring any stripping or notching.

Among other objects of the present invention is the object of providing a fuse plug in which the assembly of the fuse on the cord is facilitated at a low cost without requiring wire stripping or notching. In accordance with this invention, the electrical cord is placed into the housing but without requiring any stripping or notching.

Among other objects of the present invention is the object of providing a fuse plug in which the assembly of the fuse on the cord is facilitated at a low cost without requiring wire stripping or notching. In accordance with this invention, the electrical cord is placed into the housing but without requiring any stripping or notching.

Another object of the present invention is to provide a combination plug and fuse holder which enables the ready addition of fuse protection to existing equipment or appliances virtually without the use of any tools. If an appliance or equipment is only provided with the usual plug and it is desired to provide fuse protection, then the combination plug and fuse holder of this invention may readily be substituted in place for the conventional plug. This thus then provides the dual operation of a plug and a fuse with the incorporation of a single unit to the electrical cord.

A further object of the present invention is to provide a fusing arrangement for an electrical cord in which fuse replacement is permitted only when the unit is unplugged from an electrical outlet. Furthermore, in accordance with this invention, the fuse can be replaced without disturbing any electrical contact points to the wire.

Still another object of the present invention is to provide a combination fuse holder and plug as an integral unit and one in which the electrical cord is not easily disengagable with the housing.

Another object of the present invention is to provide a combination fuse holder and plug that is preferably in a single unit thus eliminating any separate two-piece unit. This is accomplished by making the end connector or plug embodied in a housing that also forms a fuse holder.

SUMMARY OF THE INVENTION

To accomplish the foregoing and other objects of this invention there is provided a combination fuse holder and plug preferably formed in an integral unit and preferably of a fire-retardant plastic material. This housing is preferably formed in three separate members including a base member, an overlying body member and an end member. The body member is hinged along an edge from the base member and the end member is similarly hinged from an end edge of the base member. The base and body members together define a channel for accommodating the electrical cord. Also, the base member has an elongated slot or pocket for accommodating the majority of the fuse. The fuse plug normally accommodates an elongated cylindrical buss fuse. One end of this fuse extends into an accommodating opening in the end member for contact by one of the prongs. The other prong is supported from the body member having an inner end directly contacting one of the conductors of the electrical cord. The other conductor of the electrical cord contacts a further contact member that is engaged with the fuse. The electrical circuit is thus formed with the fuse in series with one of the conductor leads of the cord.

As previously mentioned, the separate members comprising the apparatus of this invention are hinged relative to each other. In addition, means are provided for enabling the snapping together of these various members for the purpose of providing a unitary fuse holder and plug. The accommodating channel or pocket for the fuse is dimentioned so that the fuse will slide easily in the pocket but only when the end member is hinged away from the base and body members. Thus, for replacement of the fuse, the end member simply needs to be hinged open to expose an end of the fuse which can be easily withdrawn. A new fuse can then be inserted into the pocket and the end member may then be hinged from the base member and moved into a locked position to provide a unitary apparatus.

DESCRIPTION OF THE DRAWINGS

Numerous other objects, features and advantages of the invention should now become apparent upon a reading of the following detailed description taken in conjunction with the accompanying drawing, in which:

FIG. 1 is a perspective view showing the fuse holder and plug in a preferred embodiment in accordance with the present invention;

FIG. 2 is a cross-sectional view taken through the apparatus along line 2—2 of FIG. 1;

FIG. 3 is a transverse cross-sectional view taken through the end member along line 3—3 of FIG. 2.

FIG. 4 is a second transverse cross-sectional view taken along line 4—4 of FIG. 2 at one end of the base and body members;

DETAILED DESCRIPTION

Figure 5:
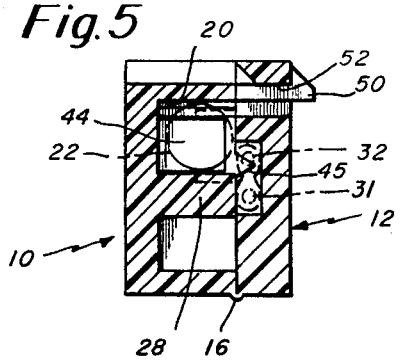
FIG. 5 is a third cross-sectional view taken along line 5—5 of FIG. 2.
Figure 6:
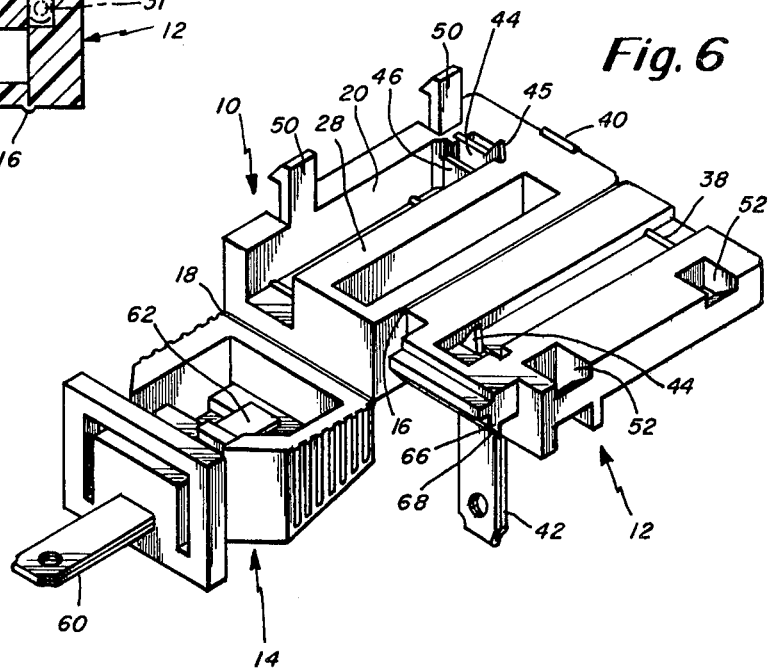
FIG. 6 is a further perspective view showing the fuse holder and plug in its opened position.

Referring now to the drawing, there is shown a preferred embodiment for the fuse plug of this invention. This device embodies in a single integral unit both an A/C type plug and a fuse holder. The housing comprising the fuse plug is readily separable preferably by hinging to permit easy replacement of the fuse. One of the advantages of the construction of this invention is that the fuse can only be replaced, however, with the unit unplugged. The fuse holder of this invention may be used with any appliance or the like electrical equipment especially those now requiring fuse protection directly in the electrical cord.

The plug-in fuse holder of this invention comprises a housing that is made up of three separate housing sections identified herein as base member 10, overlying body member 12, and end member 14. Each of these members are perfectly constructed of the same material such as a fire-retardant plastic. These different housing members interact primarily by means of elongated hinge lines between different of these members as explained hereinafter. This hinge line is defined by a relatively thin plastic bridge between the different members of sufficient thickness so as not to break but also sufficiently thin to function as a hinge. In the drawing there is shown a hinge 16 along an elongated edge interconnecting the base member 10 and the overlying body member 12. Similarly, there is provided a hinge 18 at a bottom edge of the base member for hingedly interconnecting the base member 10 and the end member 14.

The base member 10 is of generally rectangular shape having an elongated channel or pocket 20 for accommodating the majority of the length of the fuse 22. The fuse may be of many different types and amperage ratings. One fuse that may be employed is a buss AGC 7. As depicted in the drawing, the fuse includes metal end caps 23 and 24. The section of the fuse 22 including the end cap 24 it is noted extends outwardly from the base member 10 into an accommodating slot 26 in the end member 14.

The base member 10 also has an upright wall 28 relatively centrally disposed along the member and defining one side of the channel 20. The top surface of this wall also forms a rest surface for one side of the electrical cord as described hereinafter. The electrical cord 30 may be a conventional type of cord having the two conductors 31 and 32. One of these conductors makes contact with one end of the fuse while the other conductor makes direct contact with one of the plug prongs as described hereinafter.

The body member 12 is also of substantially rectangular shape. On its internal surface, there is provided an elongated groove 36 that is open to the outside. This groove has a width and a depth that is adapted to readily accommodate a conventional electrical cord. As noted in the drawing, the cord also rests upon the top surface of the wall 28 of the base member 10. At the outer end of the groove 36 there is provided a triangular ridge transversely across the groove identified in the drawing as ridge 38. Similarly, there is a corresponding ridge 40 that is extending outwardly from the base member 10. These are relatively small ridges. However, when the base and body members are interlocked the tendency is for these ridges to grip the cord and relieve any strain on the contact points with the conductors.

The overlying body member also has a thin passageway for accommodating electrical prong 42. The hole in the body member is arranged so that the prong is tightly fitted in the body member. The prong has a lower pointed end 44 that is adapted to engage the conductor wire 31 when the base and body members are interlocked. Very similarly, at the other end of the base and body members there is provided a contact piece 44 having a pointed end 45 that is adapted to pierce the other conductor 32 when the base and body members are interlocked. The contact 44 also has a turned end 46 that is adapted to firmly interengage with the end piece 23 of the fuse 22.

The base member 10 is provided with two upright locking posts 50 which are adapted to pass through correspondingly positioned holes 52 in the overlying body member 12. Each of these locking posts has a barbed end so that when the body and base members are interlocked this barbed end engages with a top surface of the body member to lock the base and body members in position. The opposite side of these members is secured by means of the hinge 16.

As previously mentioned, the end cap 24 of the fuse extends into a slot 26 formed on the inside of the end member 14. It is noted that the top wall 56 of the end member is adapted to fit substantially planar with the top wall 58 of the body member 12. This top wall also receives a second prong 60 that is substantially similar to the prong 42 except that this is a longer prong having a base 62 that extends into the slot 26 and that is adapted to electrically interconnect with the flat end of the end cap 24 of the fuse 22. Of course, when the end member 14 is hinged away from the base member 10 then the contact between the fuse and the prong 60 is interrupted.

The end member 14 is hinged along the hinge line 18 from a lower end edge of the base member 10. This hinging occurs by means of a thin plastic bridge between the different members permitting the hinging action. After the base and body members are interlocked in the manner described previously, then the end member may then be interlocked with the body member. Thus, the end member hinges with the base member but locks to a closed position by interengaging with the overlying body member. In this regard, the body member is provided with a locking post 66 having a tapered edge 68. To cooperate with this, the top wall 56 of the end member is provided with a thru passage 70 with an edge thereof interlocking with the tapered edge of the locking post.

For replacement of a fuse, the end member is simply disengaged with the locking post on the body member and the end member is hinged along the hinge 18. When this hinging occurs, the force imposed by the base of the prong 60 is relieved and the fuse is essentially in a loose position in its accommodating pocket and can be easily withdrawn. A new fuse can then be inserted and the end member is rotated back to its locked position. It is noted that because the two prongs are rotated away from each other to replace the fuse, this fuse replacement cannot occur with the plug plugged in.

Having described one preferred embodiment of the present invention, it should now be apparent that numerous other embodiments and modifications are contemplated as falling within the scope of this invention. For example, the fuse plug can be constructed in different sizes and could be adapted for accommodating different length or configuration fuses.

What is claimed is:

1. A combination plug and fuse holder adapted for receiving a multi-conductor cord and comprising;

a first insulated housing member having a passage for receiving the electric cord and a pocket extending substantially parallel to the passage and adapted to receive a fuse, contact means for electrically coupling one conductor of the cord to one side of the fuse, first prong means supported in said first insulated housing member for electrical coupling to the other conductor of the cord, a second insulated housing member including means for permitting the separation apart of the first and second housing members and for further interlocking these members, and a second prong means supported in the second insulated housing member extending in parallel with the first prong means but only in the interlocked position of the housing members, said second prong means for electrical coupling to the other side of the fuse, said first insulated housing member comprising a base member and a body member, and means for relativly hinging the base and body members with the pocket and passage defined therebetween, means for hinging said second housing member from said base member at the end thereof, said hinging means between the base member and body member, and said hinging means between the base member and second housing member being disposed, respectively, along different sides of the base member, said second insulated housing supporting only the second of the first and second prong means, and the body member supporting only the first of the first and second prong means, said second insulated housing and body member having one of two alternate positions relative to said base member including an interlocked position in which the first and second prong means extend in parallel and an open position in which the second insulated housing and body member are hinged away from the base member displacing the second prong means out of parallel with the first prong means and permitting access to the fuse to enable removal thereof.

2. A combination plug and fuse holder as set forth in claim 1 with said base member having the pocket therein and the body member having the passage therein.

3. A combination plug and fuse holder as set forth in claim 1 wherein said second prong means has an internal end engageable with the other side of the fuse but only when the first and second housing members are interlocked.

4. A combination plug and fuse holder as set forth in claim 1 including means for interlocking the housing members together to form an integral device.

5. A combination plug and fuse holder as set forth in claim 1 including interlock means including first interlock means for interlocking the base and body members and second interlock means for interlocking the second insulated housing member and the body member.

6. A combination plug and fuse holder as set forth in claim 1 wherein said contact means has an end adapted to pierce the cord and make contact with said one conductor, and another end positioned to contact the one side of the fuse.

7. A combination plug and fuse holder as set forth in claim 6 wherein the first prong means has an end adapted to pierce the cord and make contact with said other conductor of the cord.

8. A combination plug and fuse holder as set forth in claim 1 wherein the both hinging means extending along the base member at adjacent edges of the base member defining respective hinges lines extending at a right angle to each other.

9. A combination plug and fuse holder as set forth in claim 8 wherein the hinge means for the body member is along an upper edge of the base member while the hinging means for the second insulated housing is along a lower edge of the base member.

10. A combination plug and fuse holder as set forth in claim 1 including releasable interlock means including at least one interlock member for interlocking the second insulated housing member and the body member, said interlock means being disposed between said first and second prong means.

11. A combination plug and fuse holder as set forth in claim 10 wherein said interlock means is also disposed between said first prong means and said pocket.

12. A combination plug and fuse holder as set forth in claim 1 in combination with a fuse wherein said fuse when in said pocket extends beyond an end wall of said body member.

13. A combination plug and fuse holder as set forth in claim 12 wherein said second insulating housing member has a recess therein for receiving the extending end of said fuse.

* * * * *